US010604994B2

(12) United States Patent
Logsdon, Sr.

(10) Patent No.: US 10,604,994 B2
(45) Date of Patent: Mar. 31, 2020

(54) GARAGE DOOR (DROP DOWN) BREEZE SCREEN

(71) Applicant: Richard Eugene Logsdon, Sr., Bellevue, NE (US)

(72) Inventor: Richard Eugene Logsdon, Sr., Bellevue, NE (US)

( * ) Notice: Subject to any disclaimer, the term of this patent is extended or adjusted under 35 U.S.C. 154(b) by 0 days.

(21) Appl. No.: 15/927,911

(22) Filed: Jun. 7, 2018

(65) Prior Publication Data

US 2018/0340367 A1 Nov. 29, 2018

Related U.S. Application Data

(60) Provisional application No. 62/489,769, filed on Apr. 25, 2017.

(51) Int. Cl.

| | |
|---|---|
| ***E06B 7/10*** | (2006.01) |
| ***E06B 9/02*** | (2006.01) |
| ***E06B 9/52*** | (2006.01) |
| *E06B 5/00* | (2006.01) |

(52) U.S. Cl.

CPC ..... *E06B 7/10* (2013.01); *E06B 9/02* (2013.01); *E06B 9/52* (2013.01); *E05Y 2900/106* (2013.01); *E06B 5/003* (2013.01); *E06B 2009/527* (2013.01)

(58) Field of Classification Search

CPC ..... E06B 7/10
USPC ..... 49/38
See application file for complete search history.

(56) References Cited

U.S. PATENT DOCUMENTS

| | | | | |
|---|---|---|---|---|
| 4,378,043 | A * | 3/1983 | Sorenson | E06B 7/03 160/201 |
| 4,653,566 | A * | 3/1987 | Miale | E06B 9/54 160/113 |
| 5,611,382 | A * | 3/1997 | Sferra | E06B 9/52 160/113 |
| 5,860,465 | A * | 1/1999 | Eastridge | E06B 3/485 160/113 |
| 5,904,199 | A * | 5/1999 | Messner | E06B 7/03 160/127 |
| 6,092,580 | A * | 7/2000 | Lucas | E06B 3/485 160/113 |
| 6,557,614 | B1 * | 5/2003 | Lampers | E06B 7/02 160/113 |
| 7,143,803 | B2 * | 12/2006 | Mitchell | E06B 3/485 160/113 |
| 9,512,668 | B1 * | 12/2016 | Nissan | E06B 9/06 |

(Continued)

*Primary Examiner* — Joshua E Rodden

(57) ABSTRACT

The "Breeze screen" invention concept is designed to serve as a simulated natural "breeze gate" to keep garages cool and clean when they are opened. The mesh "breeze gate" feature serves to keep garbage and debris out of the inside garage space, while allowing the natural outdoor air ventilation in to keep the garage cool. It attaches to the existing garage door and can be "dropped down" and locked in place for security with its use. It functions by the design of a fine mesh panel or "screen" network, made of either metal, aluminum, plastic or other fabric of manufacturer's choice to allow airflow through the fine "air holes" that make up the "breeze gate" or "breeze screen" concept. Thus allowing air through to keep the garage cooler, but keeping larger unsightly particles out of the garage, such as leaves, trash and debris.

6 Claims, 21 Drawing Sheets

(56) References Cited

U.S. PATENT DOCUMENTS

| | | | | |
|---|---|---|---|---|
| 9,719,290 | B1 * | 8/2017 | Arroyo | E06B 7/02 |
| 9,759,011 | B2 * | 9/2017 | Leavitt | E06B 9/522 |
| 9,957,753 | B2 * | 5/2018 | Amsellem | E06B 9/52 |
| 2009/0084507 | A1 * | 4/2009 | Tescher | E06B 3/485 160/44 |

* cited by examiner

GARAGE DOOR OUTSIDE VIEW

GARAGE DOOR INSIDE VIEW

GARAGE DOOR (DROP DOWN) BREEZE SCREEN

RELATED APPLICATION

This application claims priority to provisional patent application U.S. Ser. No. 62/489,769 filed on Apr. 25, 2017, the entire contents of which is herein incorporated by reference.

FIELD OF INVENTION

The present invention relates generally to a drop-down breeze screen specifically for a garage door that allows air to enter through "air holes" in the "breeze screen concept.

BACKGROUND OF THE INVENTION

The invention is designed to serve as a simulated natural "breeze screen" to keep garages cool. It functions by design of a fine mesh screen network, made of either metal, aluminum, plantain, or other fabric of manufacturer's choice. It allows air flow through the fine "air holes" that make up the "breeze screen" concept, which helps keep the garage cooler, while keeping large particles out of the garage, such as leaves, trash, debris, and animals Additionally, exhaust fumes from vehicles temporarily idling can escape before the door is completely opened.

BRIEF DESCRIPTION OF THE FIGURES

The detailed description of some embodiments of the invention is made below with references to the accompanying figures, wherein like numerals represent corresponding parts of the figures. See also the "detailed description of certain embodiments" section for further reference.

DETAILED DESCRIPTION OF THE INVENTION

All illustrations are for the purpose of describing the selected version of the present invention and are not intended to limit the scope of the present invention. The invention relates generally to a drop-down breeze screen panel, that is comprised of a center bracket, a plurality of end brackets, a plurality of back braces that attach to the garage door panel, an optional center bracket closure, a plurality of optional open space end closures, an optional slider bracket, and a plurality of breeze screens. The center bracket is further comprised of a center insert.

The apparatus further posses a plurality of undepicted fasteners, screws and lock pins, that secure the plurality of back braces to other sub systems, a center bracket is installed and mounted directly onto the inside center of the garage door at floor level. (Center bracket is not required far garage doors under 9 ft). Two end brackets are installed directly onto the inside of the garage door at each end at floor level. The concept allows the two "end brackets" in combination with the "center bracket", to hold and allow the two panels (of manufacturer's choice or preference of materials) to function as a "breeze screen" which can slide into place.

This will then allow the air to flow in when the garage door is open, without debris entering in.

Note: When installing brackets on garage door panel, use the "breeze screen" measurements as indicated for accuracy. These measurements are for a standard 16 foot garage door, but can be modified as desired by manufacturer. Measurements suggested for standard garage, requiring two panels, each panel measuring: ⅜ in. W; 95¾ in. L, 16 in. H. This describes the complete "breeze screen" invention. READY TO OPERATE !

Although the invention has been explained in relation to its preferred embodiments, it is to be understood that many other possible modifications and variations can be made without departing from the spirit and scope of the invention.

DETAILED DESCRIPTION OF EMBODIMENTS OF INVENTION

Figure 1:
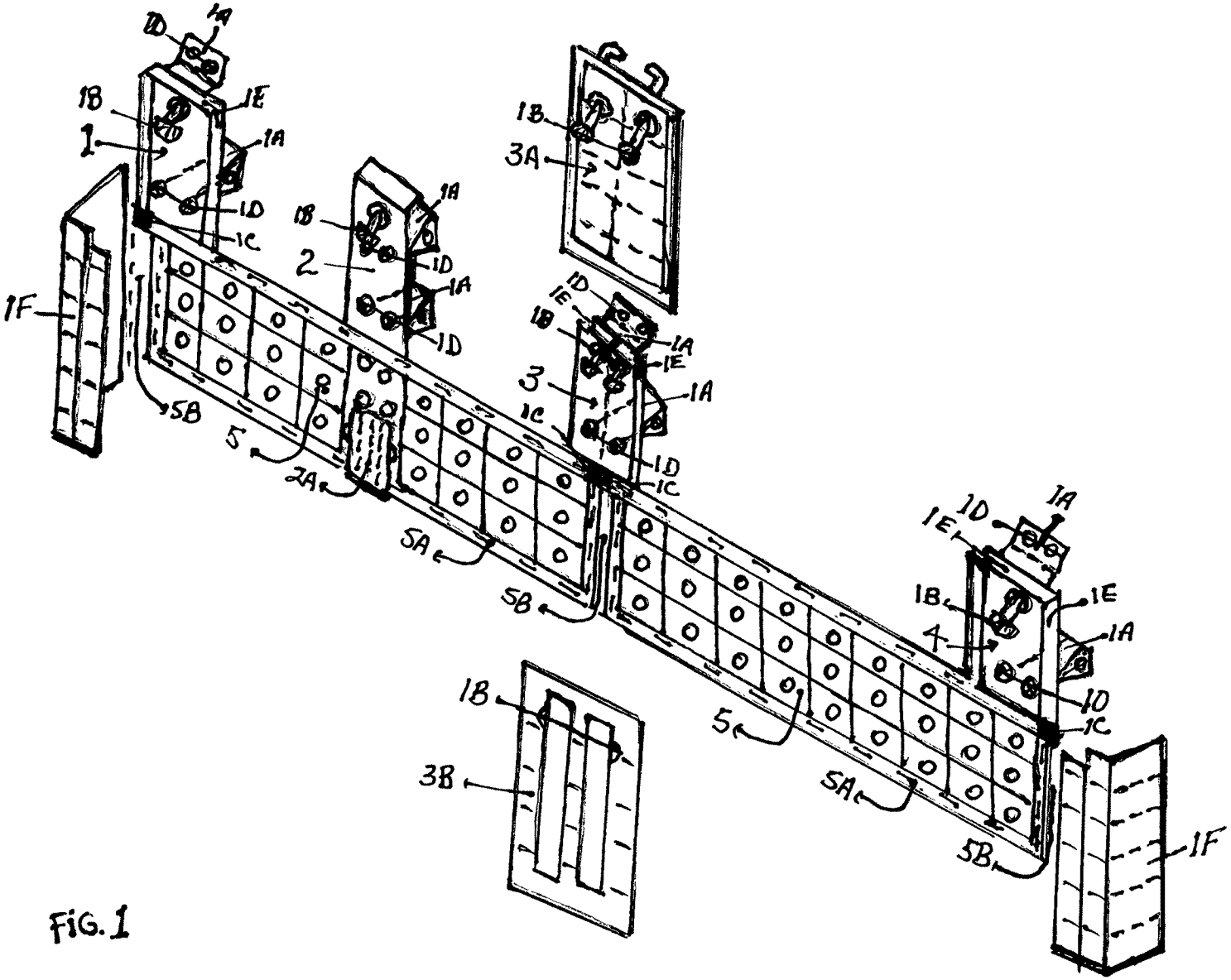
FIG. 1 is a perspective view of the apparatus thereof, with embodiments of the present invention.
Figure 2:
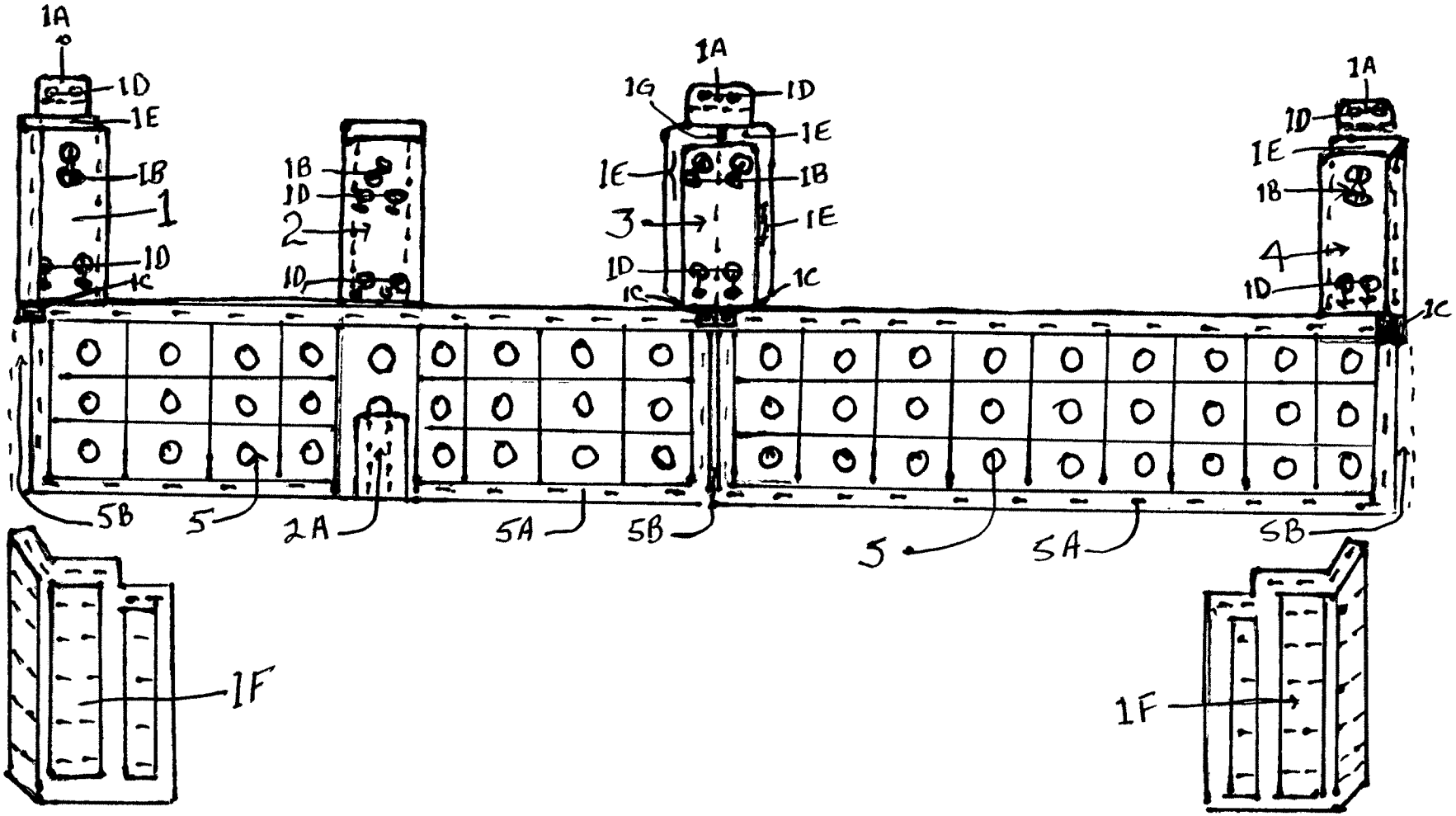
FIG. 2 is a front sectional view of the apparatus thereof, with embodiments of present invention.
Figure 3:
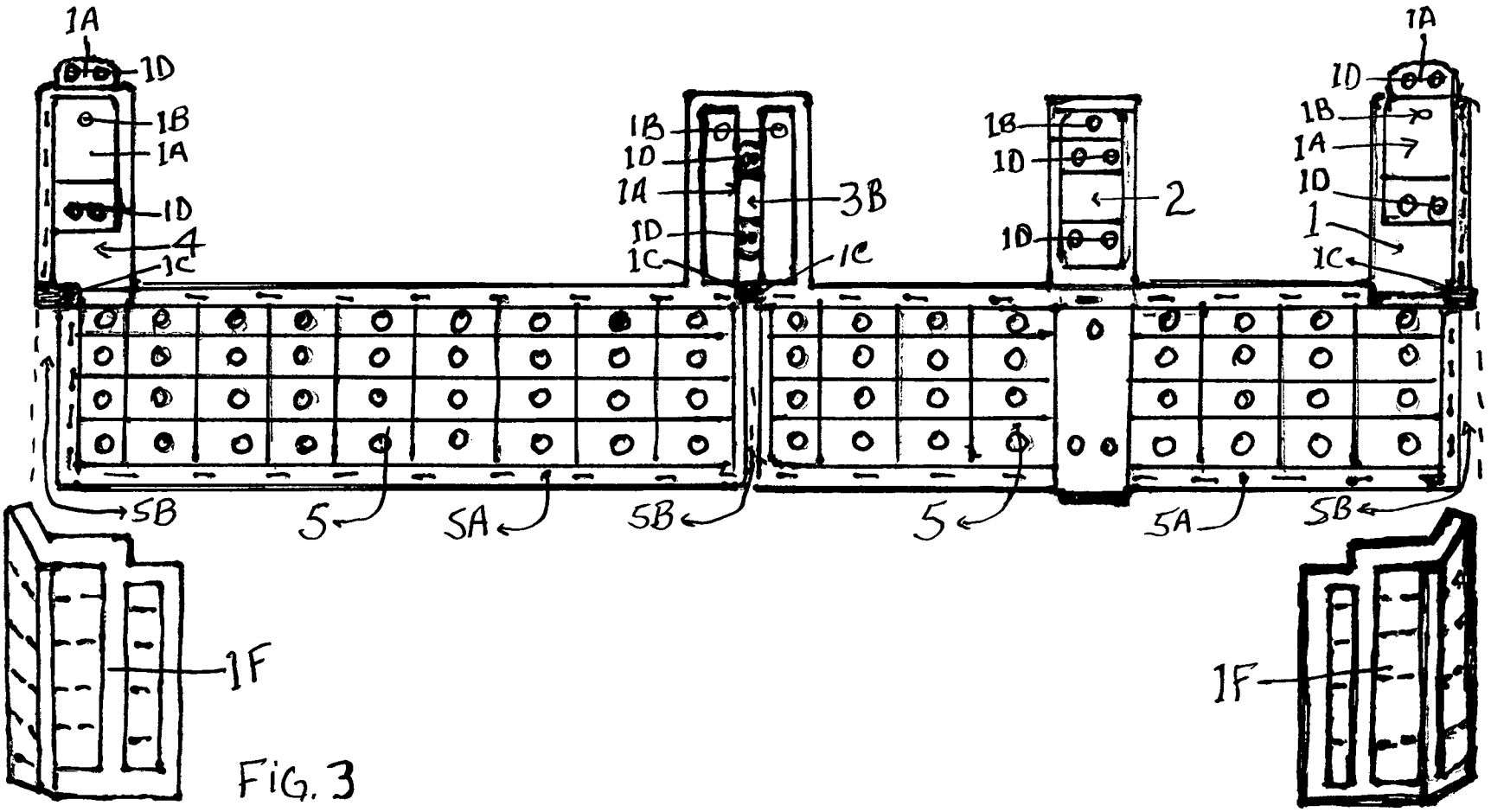
FIG. 3 is a rear sectional view of the apparatus thereof, with embodiments of present invention.
Figure 4:
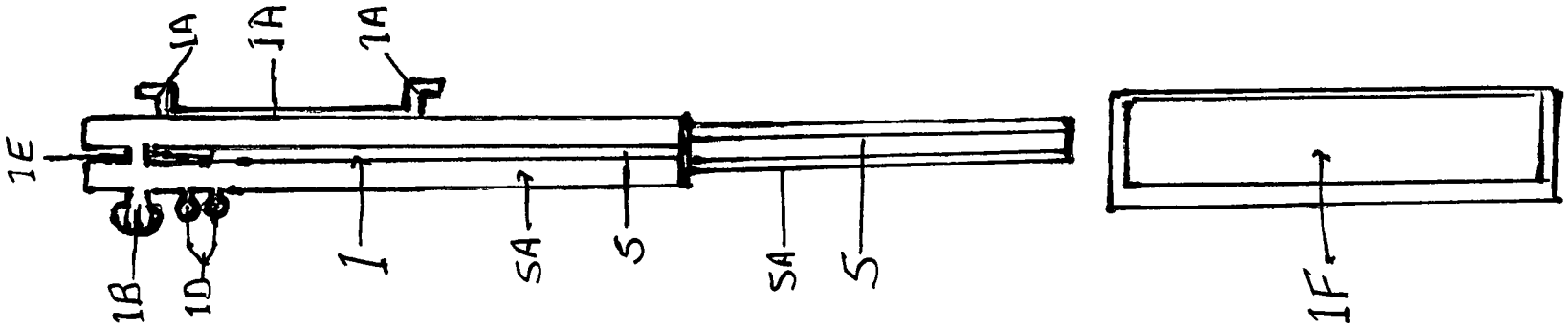
FIG. 4 is a right sectional view of the apparatus thereof, with embodiments of present invention.
Figure 5:
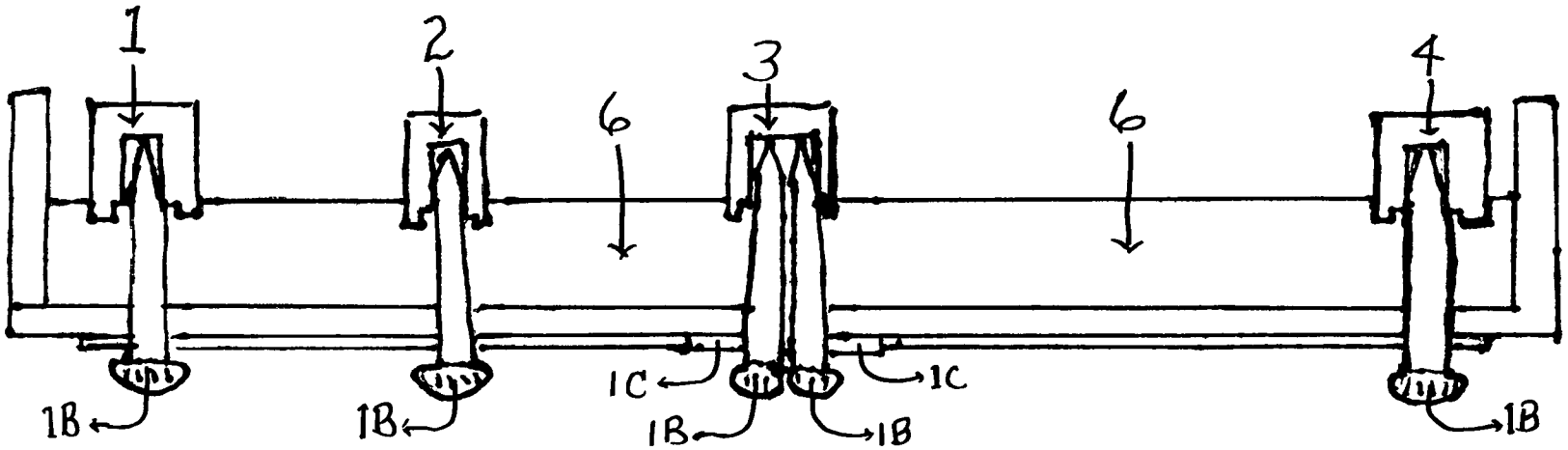
FIG. 5 is a top sectional view of the apparatus thereof, with embodiments of present invention.
Figure 6:
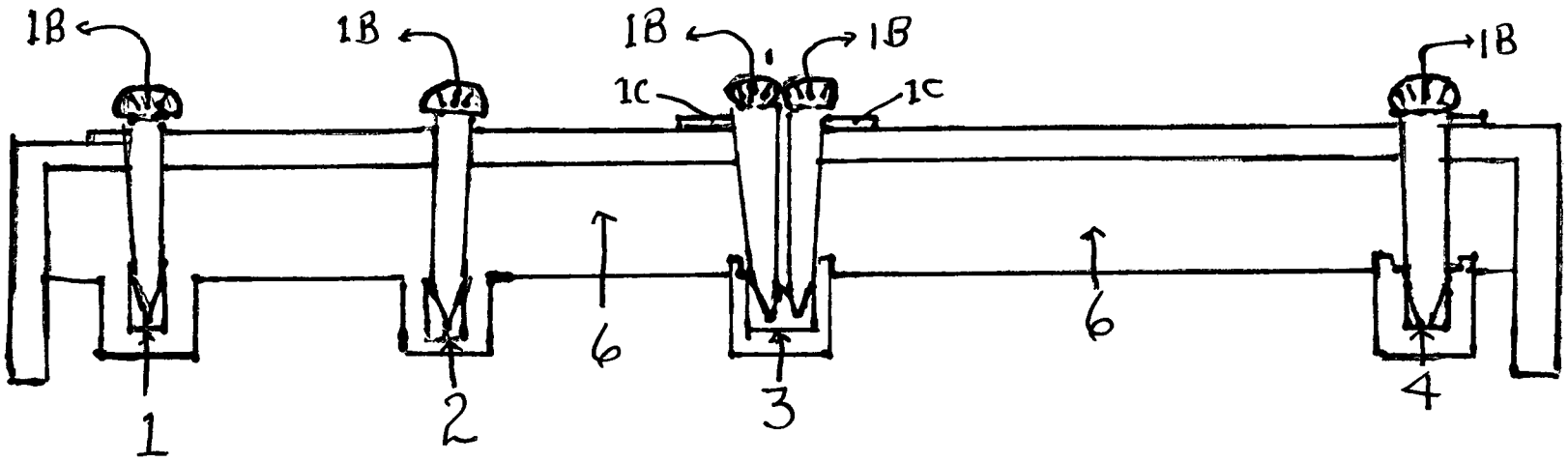
FIG. 6 is a bottom sectional view of the apparatus thereof, with embodiments of present invention.
Figure 7:
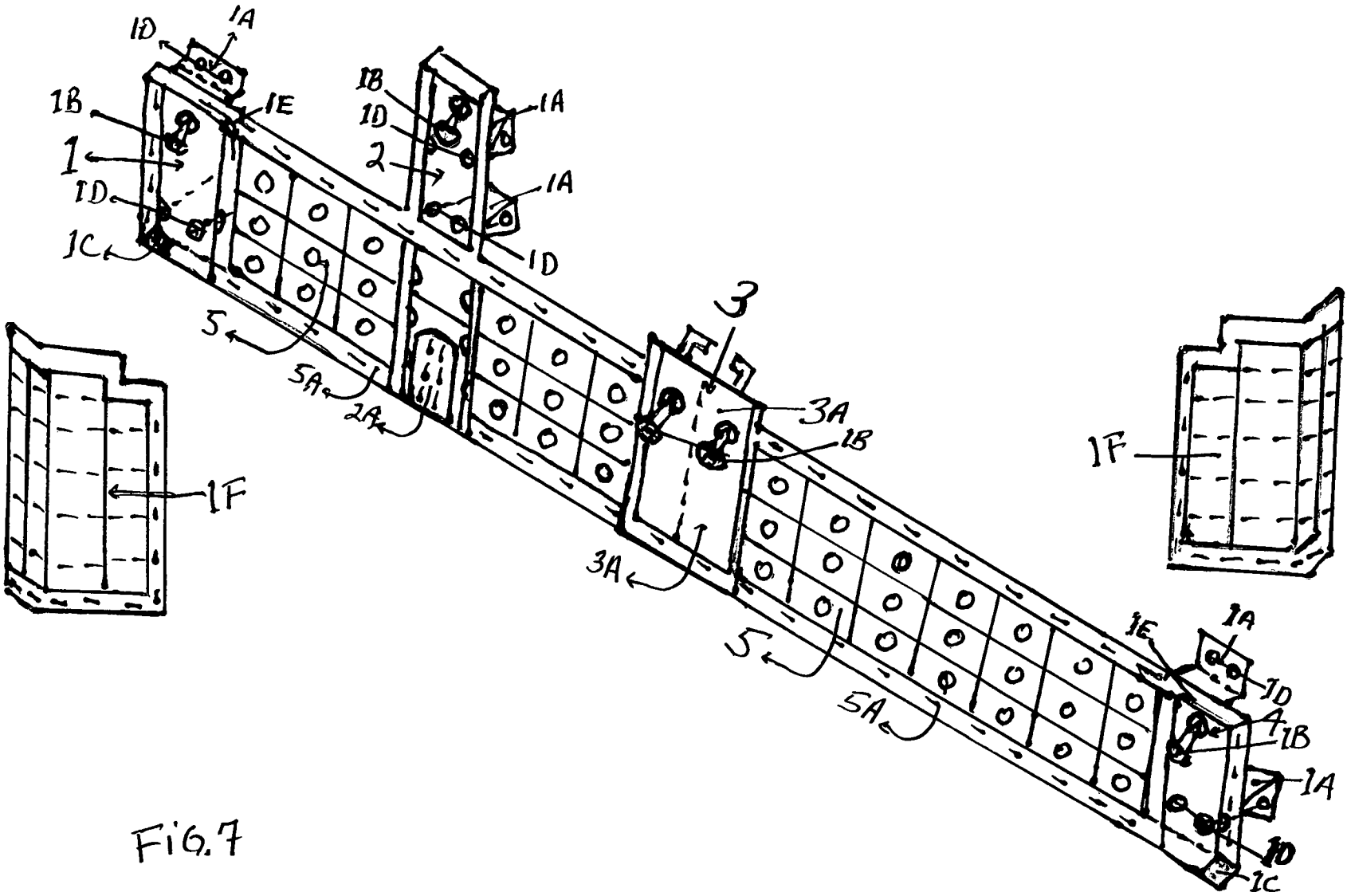
FIG. 7 is a perspective view of the apparatus where the screen is observed to be locked and garage door (not depicted) is further off the ground than the screen will extend, with embodiments of present invention.
Figure 8:
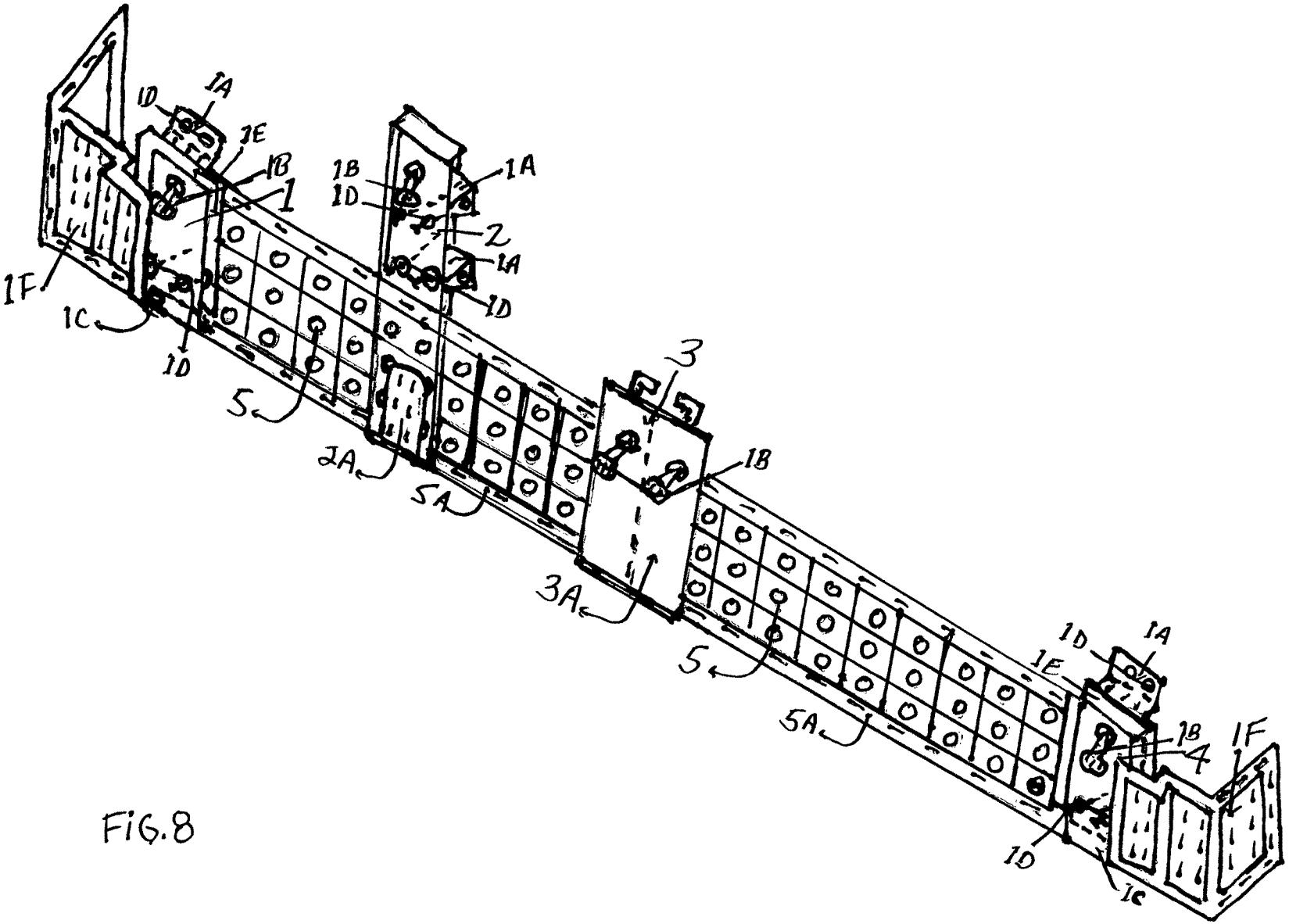
FIG. 8 is a trimetric view of the apparatus where the screen is observed to be unlocked and the garage door (not depicted) is fully lowered and would be considered flush with the ground, with embodiments of present invention.
Figure 9:
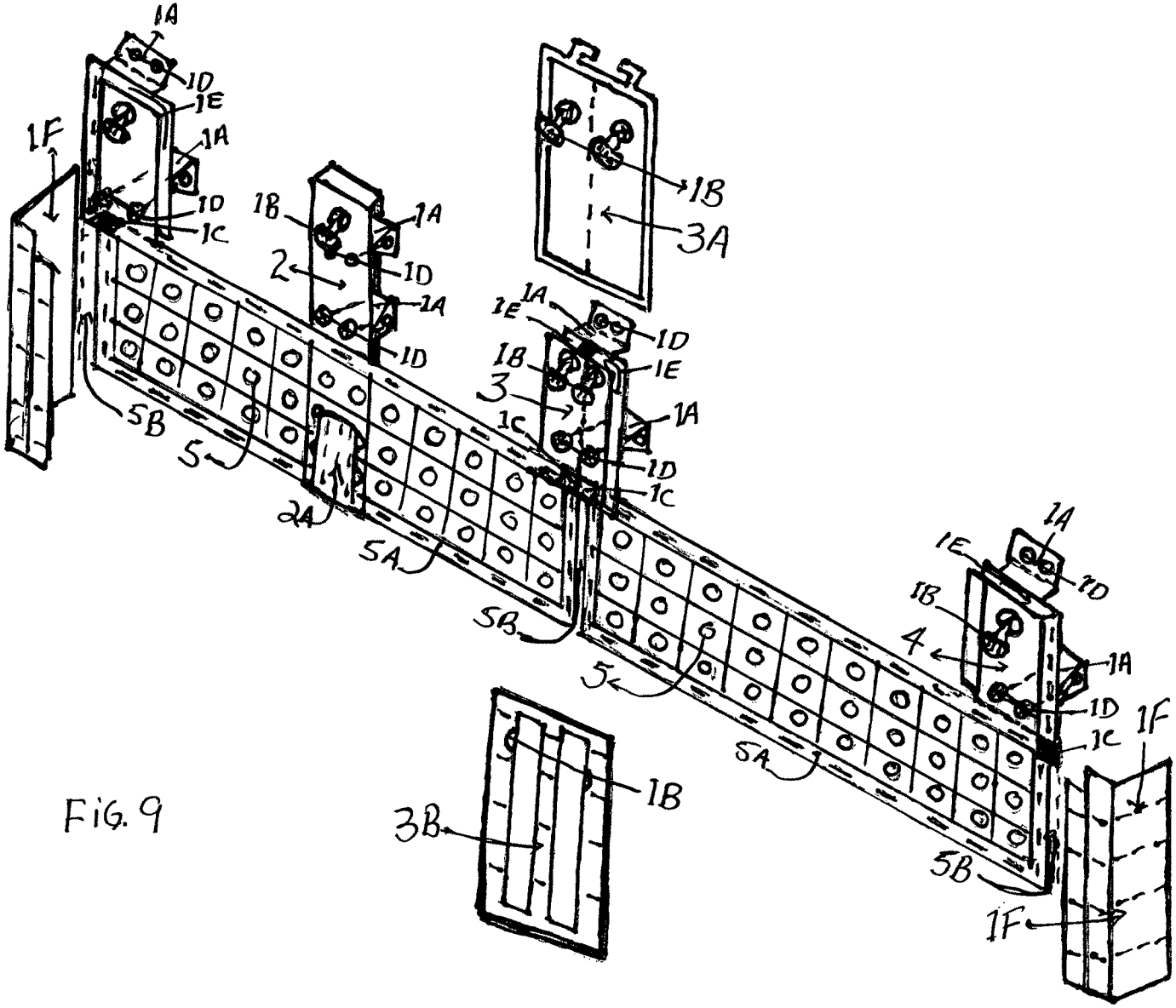
FIG. 9 is a perspective view of the apparatus where the screen is observed to be unlocked and the garage door (not depicted) is lifted off the ground to the extent the breeze screen (apparatus) will extend, with, embodiments of the invention.
Figure 10:
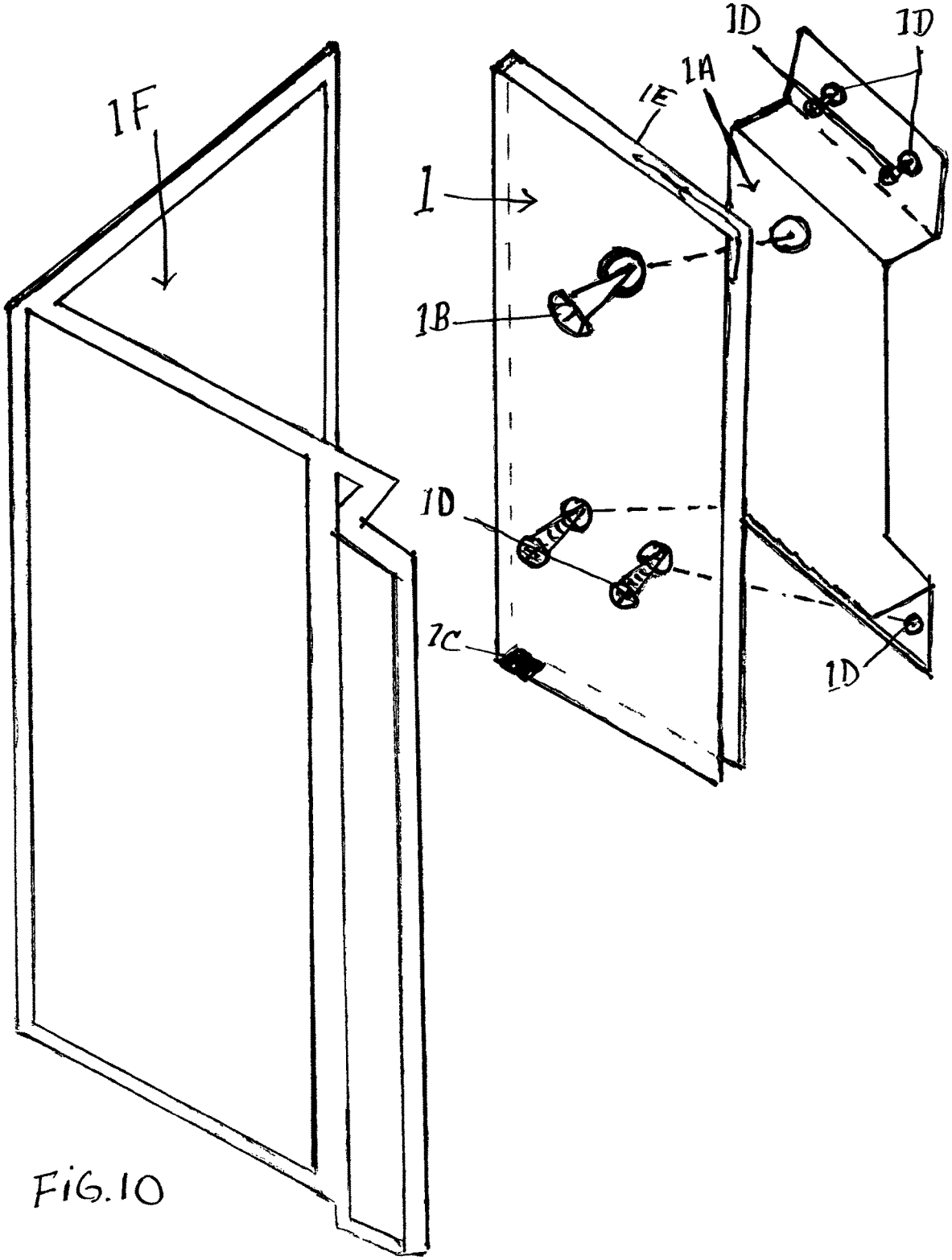
FIG. 10 is a perspective exploded view of the end assemblies consisting of the end brackets with pin lock, with two mounting screws (mid-plane sub-assembly), and back brace (rear).
Figure 11:
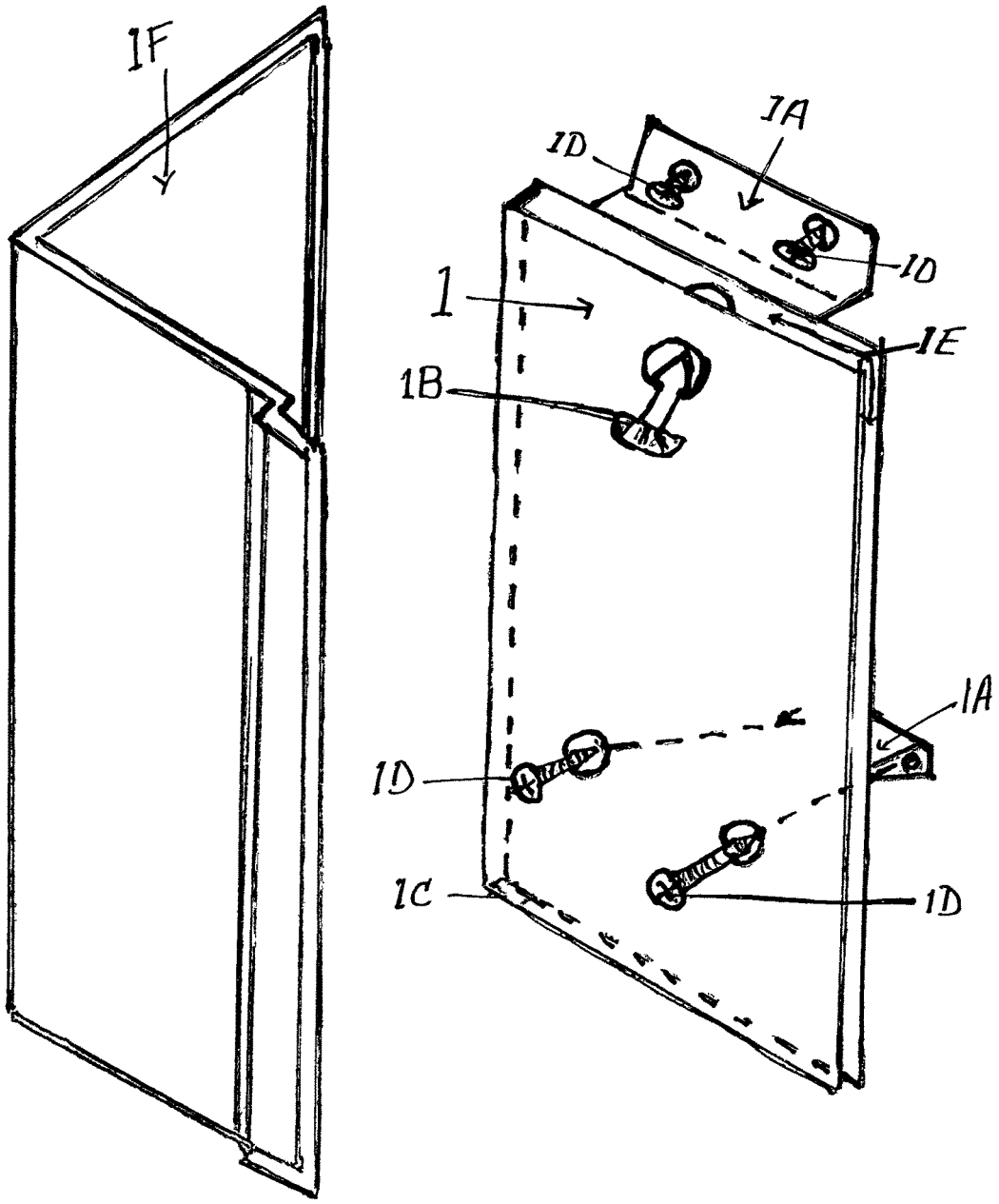
FIG. 11 is a perspective view of the end assembly thereof, where the pin lock is engaged with the end bracket, with end bracket closure (front sub-assembly).
Figure 12:
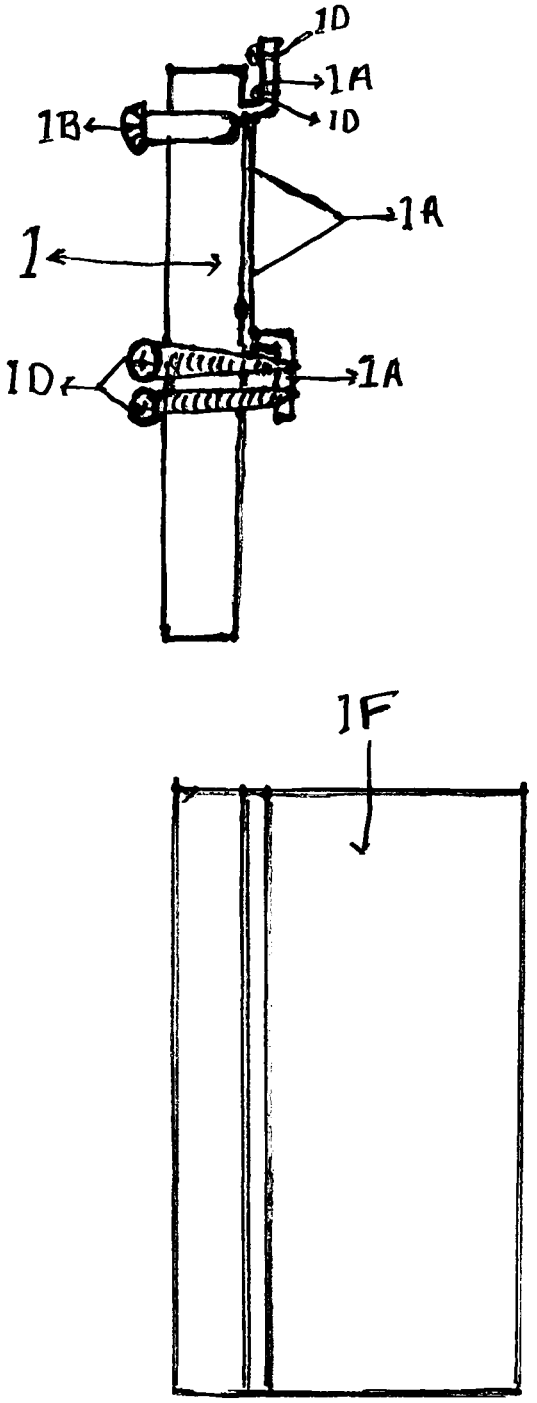
FIG. 12 is a right sectional view of the end assembly thereof, where the front face of the end bracket closure flange member, with lock pin, four mounting screws and back brace.
Figure 13:
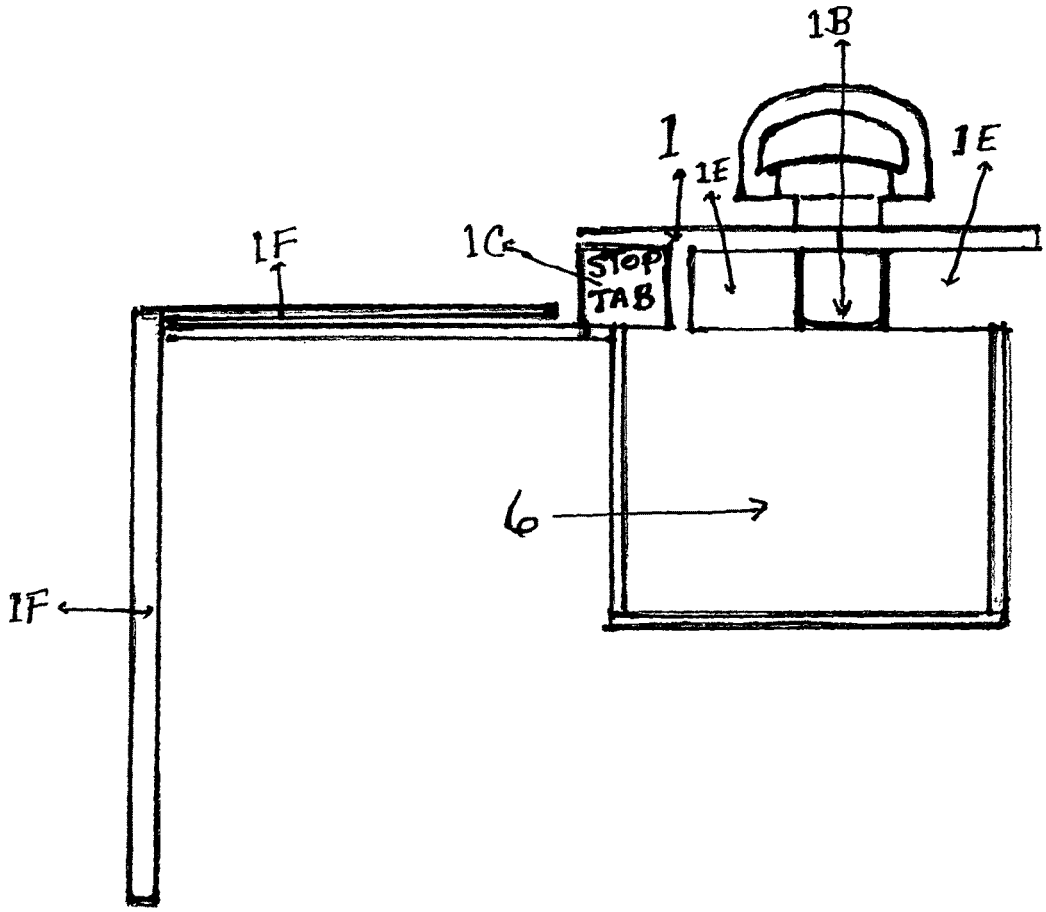
FIG. 13 is a bottom sectional view of the end assembly thereof, where the flange member possesses a square "stop tab" to restrict the motion of the end bracket, with embodiments of the invention.
Figure 14:
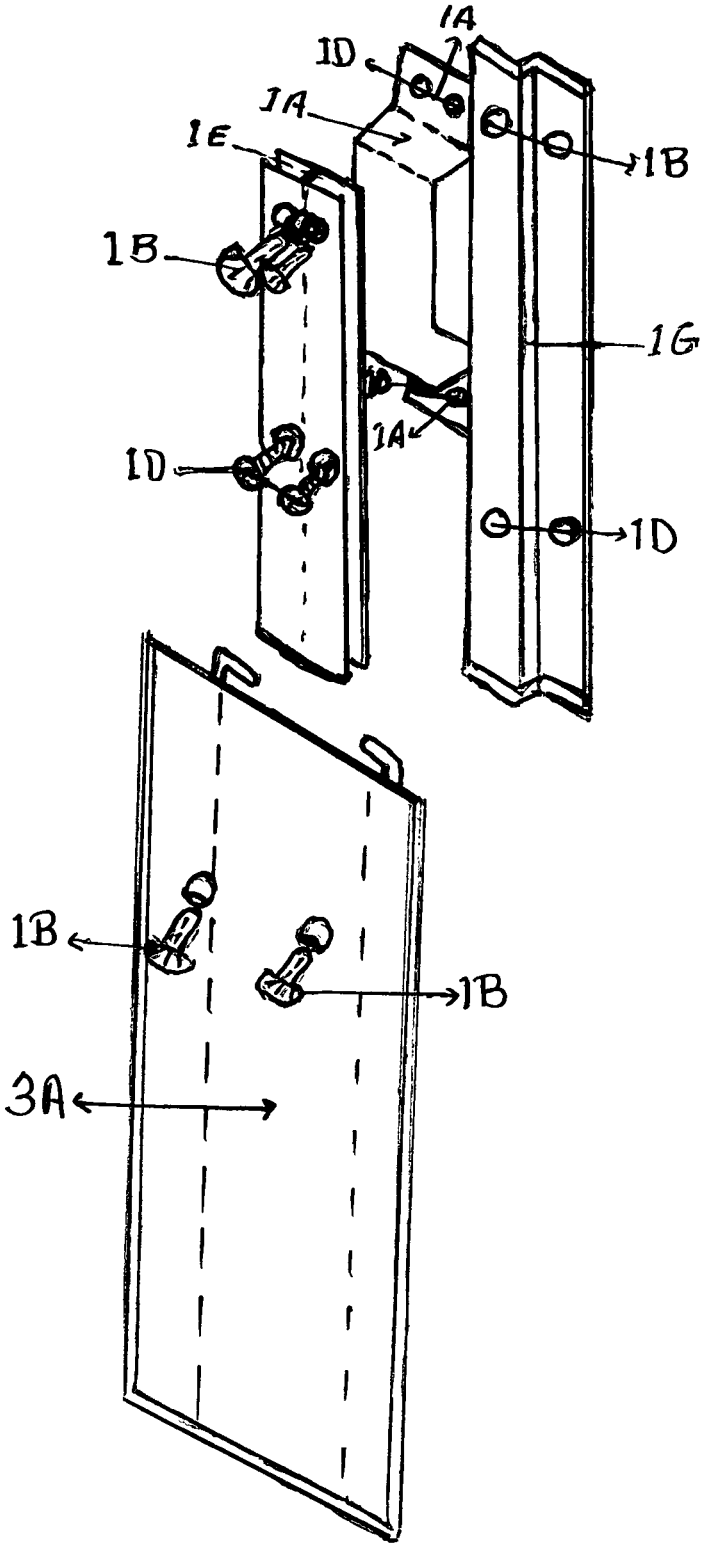
FIG. 14 is a perspective exploded view of the center bracket sub-assembly consisting of the center bracket open space closure and pin locks (front assembly), center bracket and center insert (mid plane left and mid plane right respectively), and back brace (rear).
Figure 15:
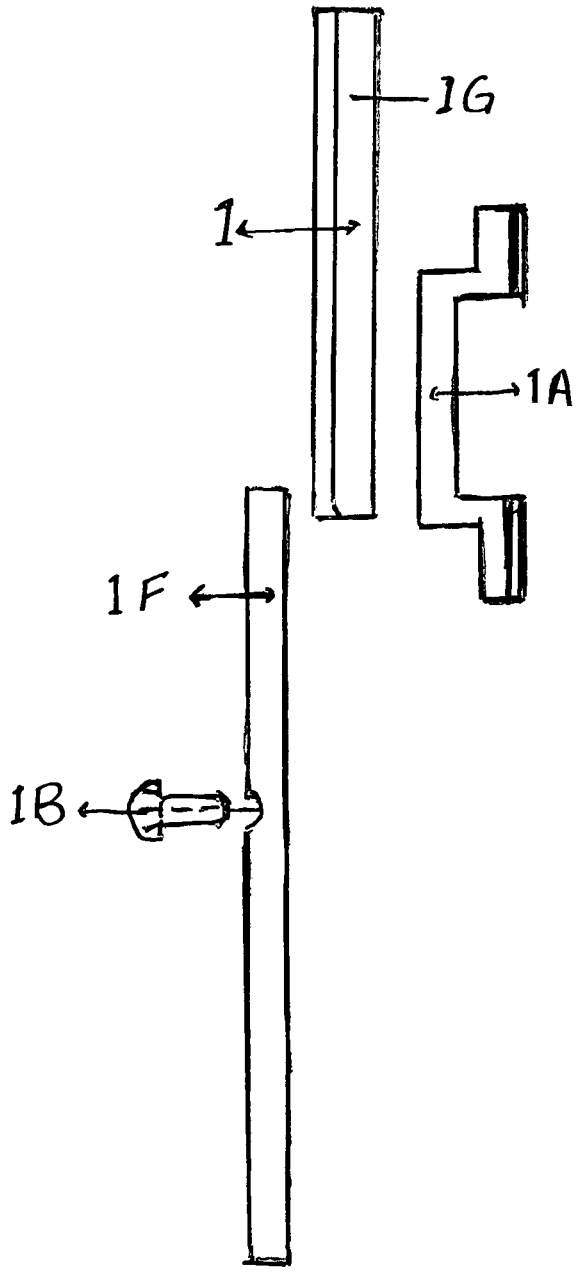
FIG. 15 is a right sectional exploded view of the center assembly thereof, where the center insert would be located within the center bracket when assembled.
Figure 16:
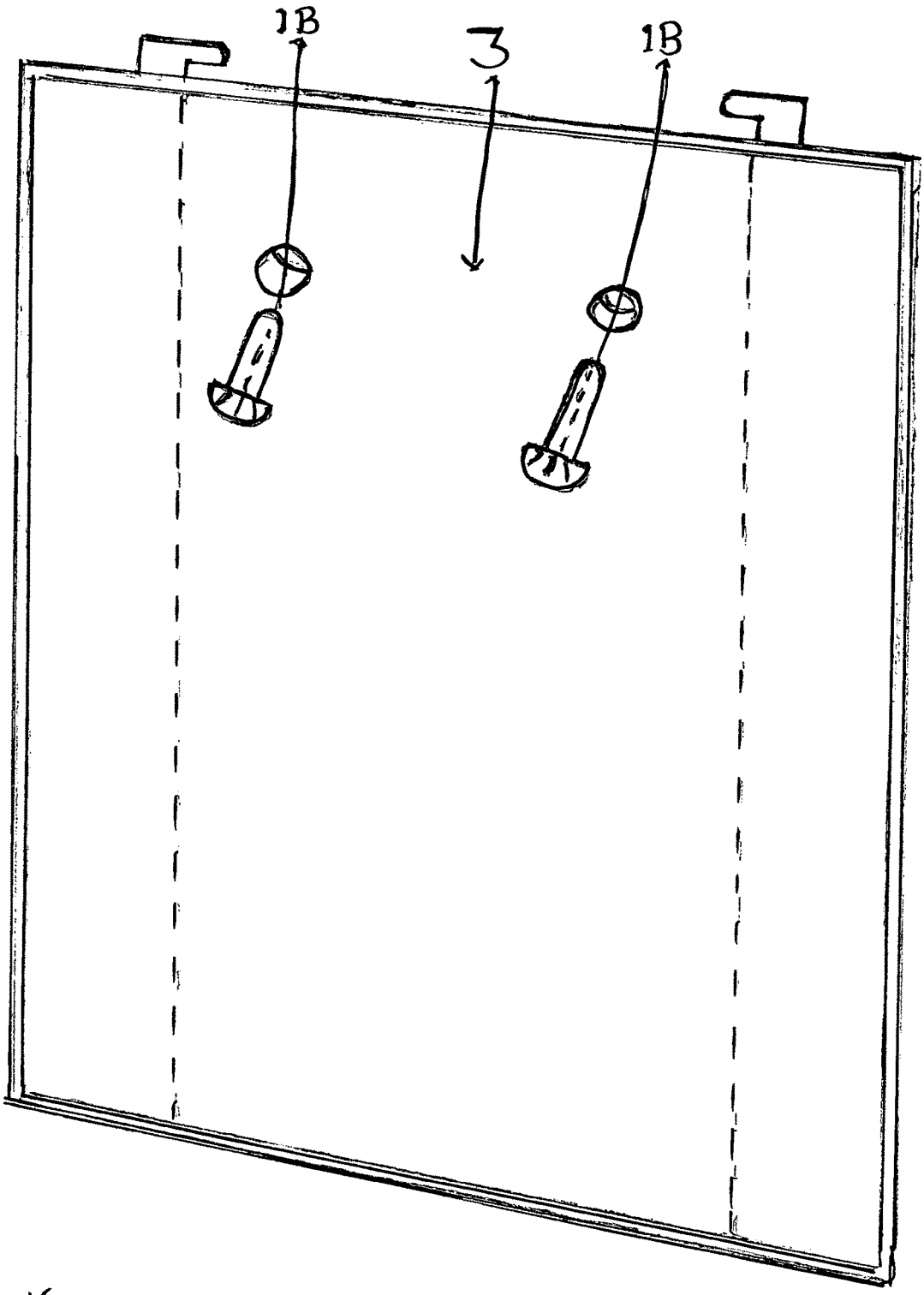
FIG. 16 is a perspective view of the center bracket sub-assembly where the pin locks are unlocked.
Figure 17:
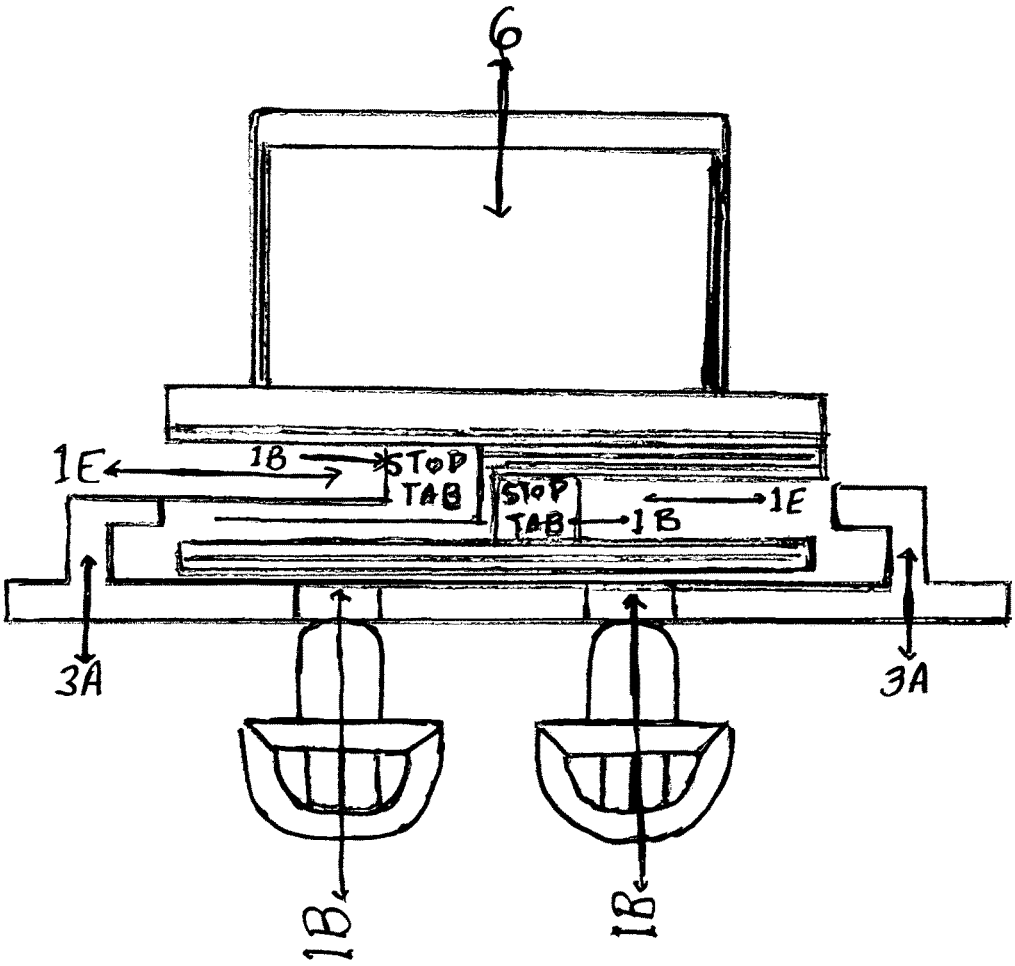
FIG. 17 is a top sectional view of the center assembly thereof, where the center bracket and center assembly thereof; where the center bracket and center insert are slotted into the flange member of the rear of the center bracket, open space closure.
Figure 18:
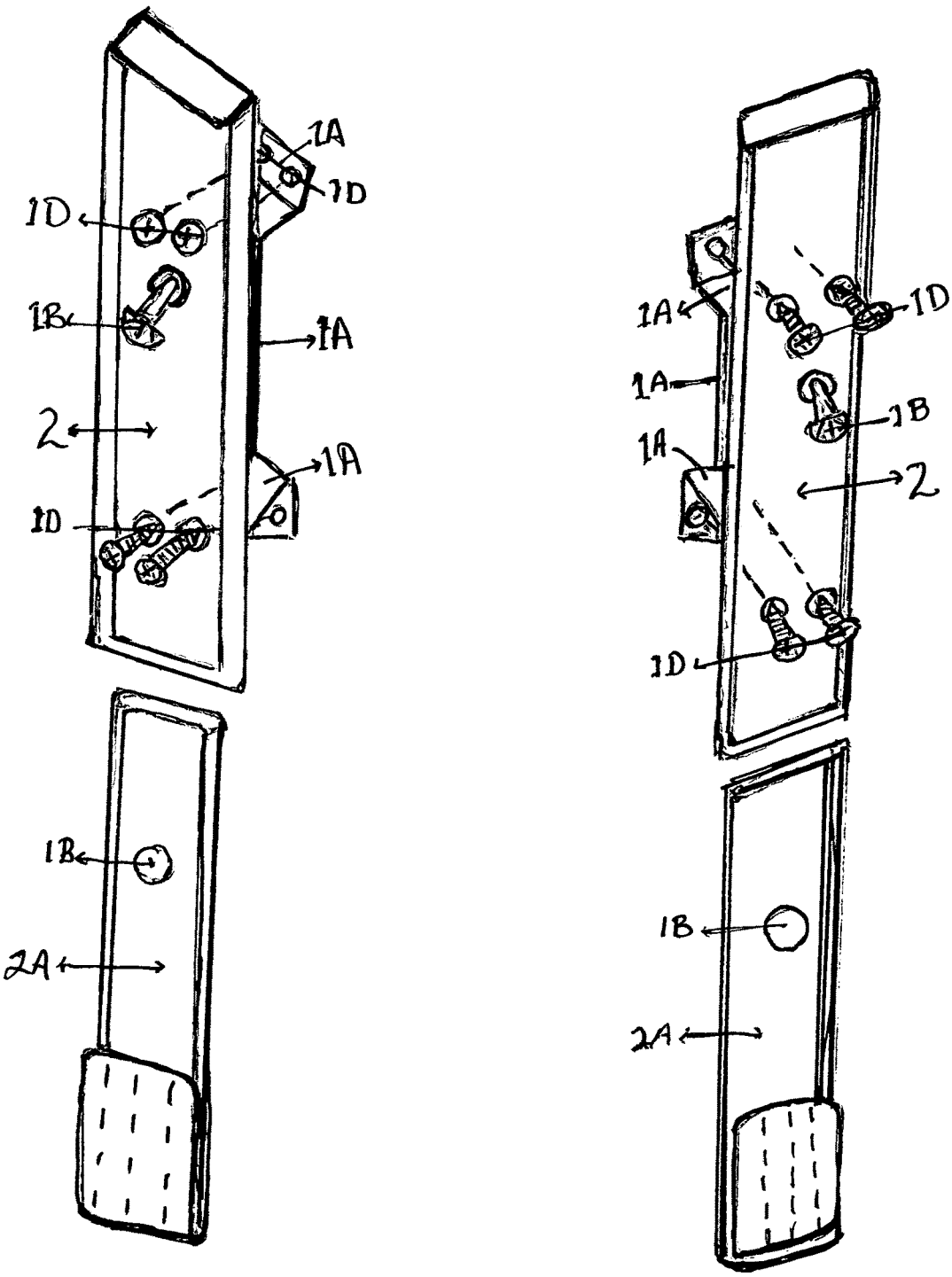
FIG. 18 is a perspective exploded view of the slide bracket sub-assembly consisting of the slide body, slide-body bracket and pinlock (mid plane top sub-assembly), slider (mid plane bottom), and back brace (rear), with mounting screws.
Figure 19:
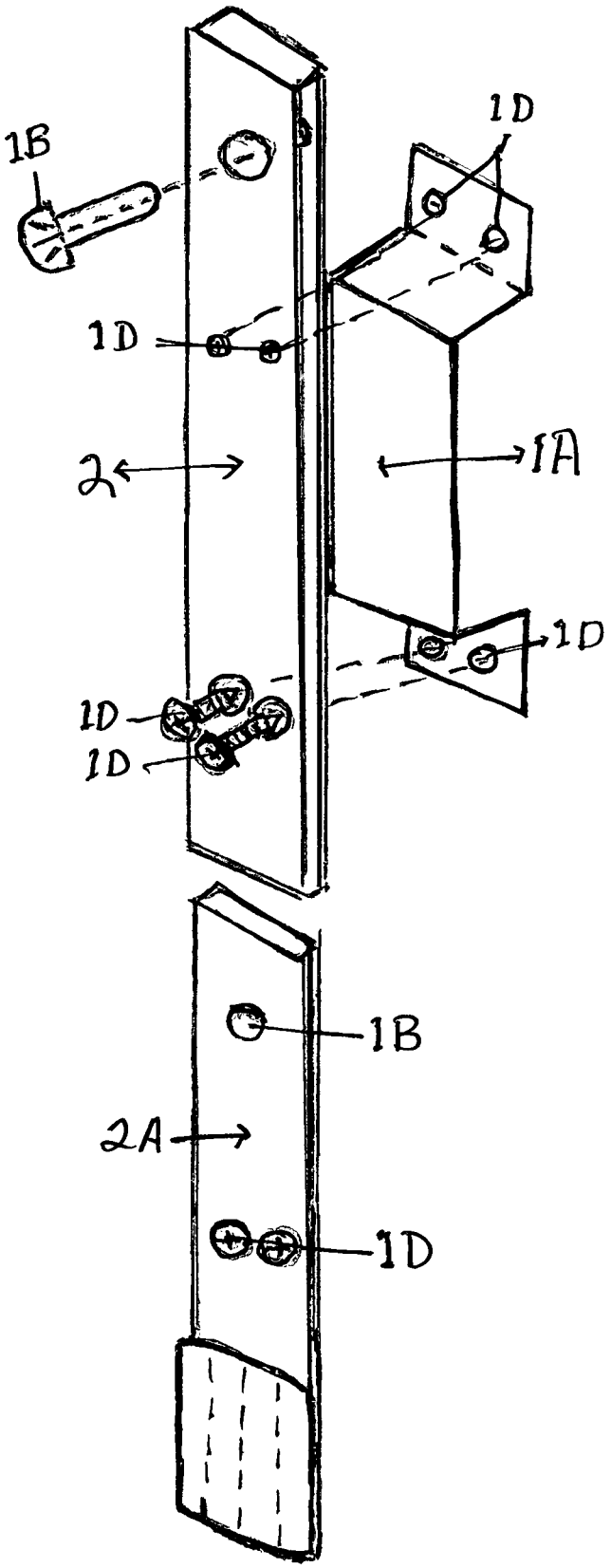
FIG. 19 is a perspective view of the slider bracket, where the slider is unlocked and extending out of the bottom of the slider body/flange and secured to the slide bracket and back brace.
Figure 20:
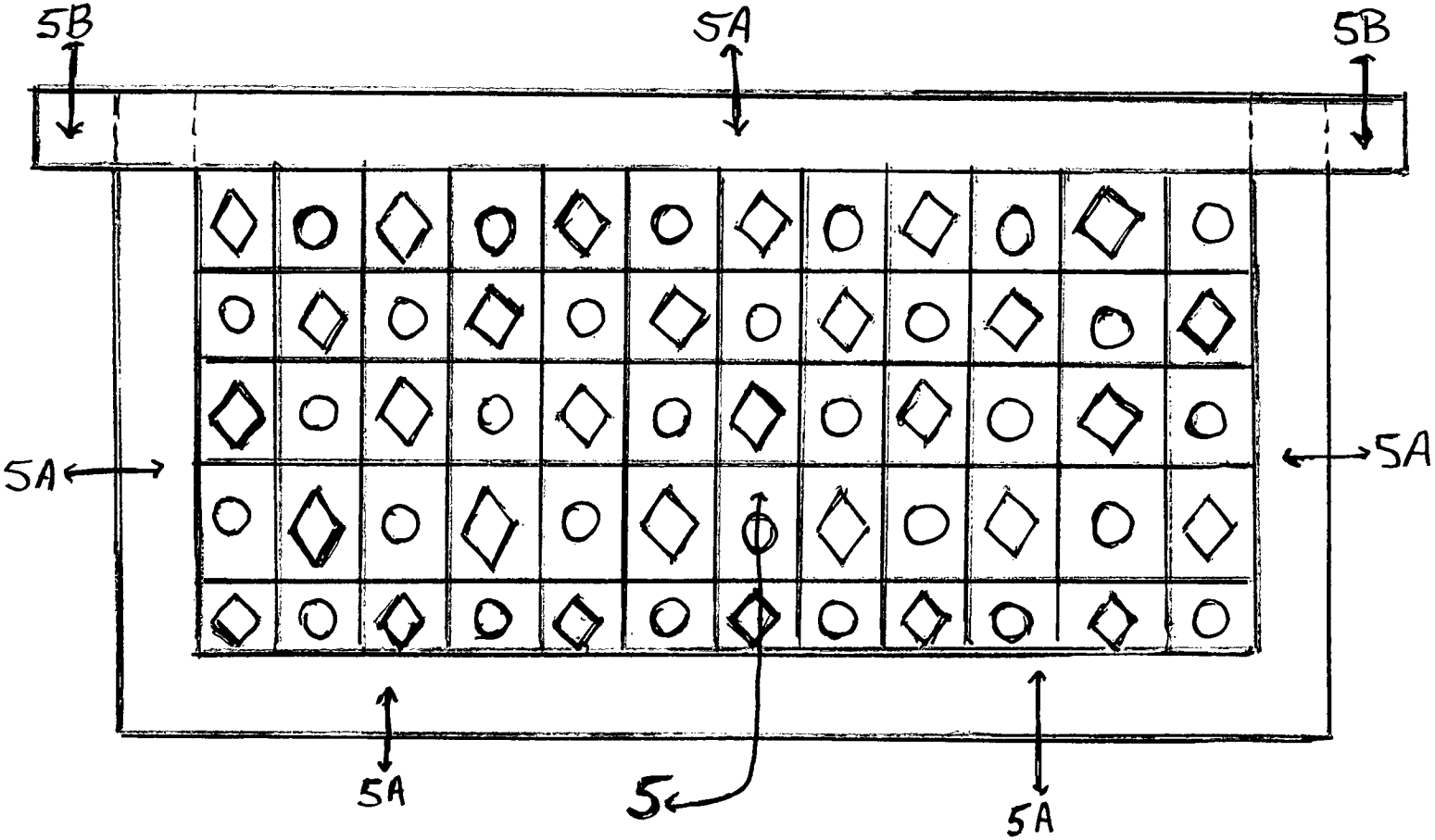
FIG. 20 is a perspective view of the breeze screen panel, which slides in the brackets attached to garage door and allows the breeze screen to function properly. (The system that operates the garage door up and down not shown in diagram).
Figure 21:
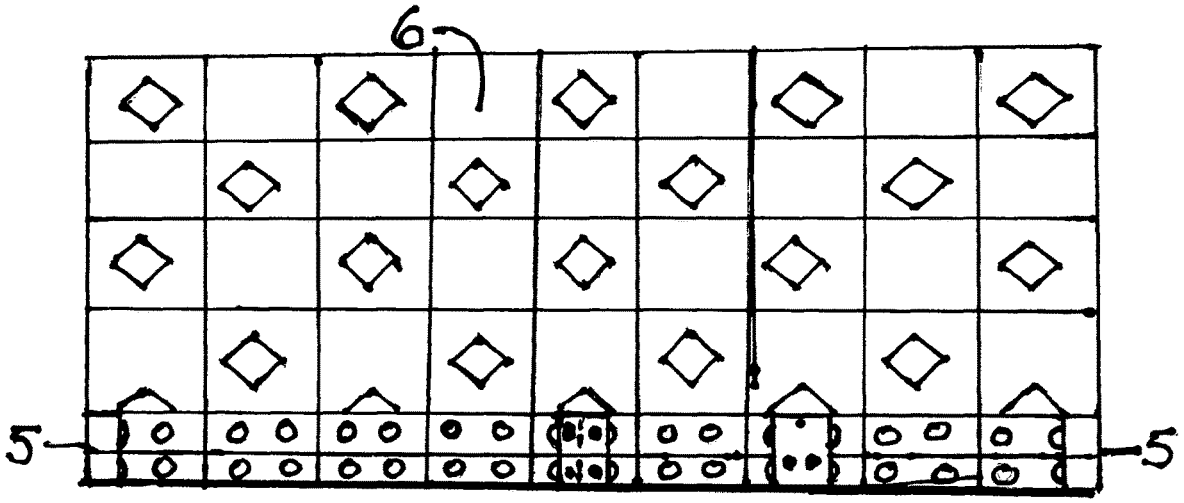
FIG. 21 is a perspective of the breeze screen panels, from an inside and outside view.
Figure 21:
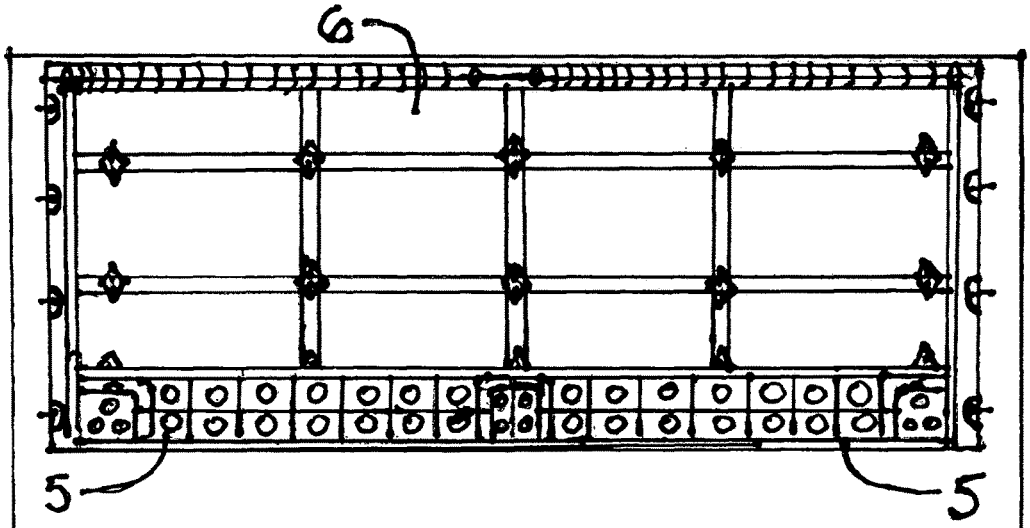

Referring to FIG. 1 is a perspective view of the apparatus, where both, the right and left 8 ft. "Breeze screen" panels (5B-5B) would be observed as "unlocked" as the garage door (not depicted) is further off the ground than the screen will extend, with embodiments of present invention attached. Garage door accessories consist of left and right "breeze screen" end brackets 1 and 4, and "optional" bracket 2, and "center" breeze screen brackets 3, back brace 1A, brackets 1, 2, 3, 4, are all attached to the garage door 6 (not depicted) with mounting screws 1D.

Lock pins 1B, hold and lock both of the "breeze screens" (5-5) in place when the door is at floor level. Left 1, 2, 3, and Right 4, depicted are "optional" panel brackets used, to hold the "breeze screen" panels (5-5), as the garage door 6 (not depicted) functions up and down. "Optional slide bracket" 2, shown attached to left panel 5, can be used (if needed) in garage door operation. Space closure brackets 1F (if needed) is placed at right and left end of apparatus 5-5, to cover open end space 5B, to keep debris from entering inside garage area.

Center "breeze screen" open space closure bracket 3, closing open space 5B, to eliminate debris from entering inside garage. Lock pins 1B, shown in closure bracket 3A, locks breeze screen panel 5-5 in place when garage door (not depicted) is lowered to ground level. Lock pins 1B, are not needed in center closure bracket 3A, when garage door 6, (not depicted) is raised or opened to functional "breeze screen" level. FIG. 10 through FIG. 20 shows other drawings and numbers of invention embodiments.

DESCRIPTION OF EMBODIMENTS IN FIGS. 1-20

(1)—Left "breeze screen bracket", mounts on garage door pane (left end) at floor level.

(2-2A)—Breeze screen slide bracket (optional), if needed for more screen stability, mounts at floor level.

(3)—"Breeze screen center bracket", mounts in center on garage door panel, at floor level.

(4)—Right "breeze screen bracket", mounts on garage door panel, (right end) at floor level.

(5-5A) "Breeze screen"—the screen and frame is a combined one piece screen embodiment, sits in brackets on door.

(5B) "Open space"—space open at end of breeze screen apparatus.

(1A) "Back brace"—Brace mounts on all brackets and mounts to garage door panel.

(1B) "Pin lock" or "Lock pin" (interchangeable), locks "breeze screen" in bracket, keeping screen from moving.

(1C) "Stop tab"—stops "breeze screen panel" from dropping out of bracket when screen bottoms out.

(1D) "Mounting screws"—mounting screws go through "screw holes" in bucket and back brace and mounts to the garage door panel.

(1E) "Slide slot"—"Breeze screen"—screen sits in this embodiment which functions by sliding up and down in the end brackets (during garage door retraction).

(1F) "End closure bracket"—Bracket sits at each end of each end of "breeze screen panel" and stops debris from entering garage area.

(1G) "Insert"—The insert in the "center bracket" divides or separates the right and left "Breeze screen panels". The two panels sit in brackets, mounted on the garage door panel.

(3A) "Center closure bracket"—Frontal view of breeze screen "center closure bracket"

(3B) "Center closure bracket"—Posterior (or back) view—the "closure bracket" embodiment slides over the front of the center bracket, which helps stop debris from entering the garage area.

What is claimed is:

1. A garage door accessory configured to increase flow of air into a garage, the garage door accessory comprising:

a left panel and a right panel, each panel configured to form an extension of a garage door, each panel in the form of a screen for allowing the air to move through each of the panels;

end brackets to secure the accessory to the garage door, a first one of the end brackets extending form a first end of the left panel and a second one of the end brackets extending form a first end of the right panel, each of the first and second one of the end brackets covering open spaces at respective ones of the first end of the left panel and the first end of the second panel;

a left bracket mounted at the first end of the left panel, the left bracket configured to mount to the garage door;

a right bracket mounted at the first end of the right panel, the right bracket configured to mount to the garage door;

a center bracket connected at a second end of each of the left and right panels, the center bracket configured to mount to the garage door;

a slide bracket attached to one of the left or right panel, the slide bracket configured to mount to the garage door, the slide bracket being located on a first side of the respective left or right panel, with the left, right and center brackets being located on a second side of the respective left or right panel;

each of the left, right, center and slide brackets including a hack brace which is configured to attach the respective bracket to the garage door.

2. The garage door accessory of claim 1, further comprising the left panel and right panel being configured to fit at least one of a standard 9 foot garage or a standard 16 foot garage.

3. The garage door accessory of claim 1, further comprising a plurality of lock pins located on each of the brackets.

4. The garage door accessory of claim 1, further comprising a plurality of mounting screws, the mounting screws for attaching each of the brackets to the respective back brace.

5. The garage door accessory of claim 1, further comprising each of the left, right and center brackets including stop tabs.

6. The garage door accessory of claim 1, further comprising a closure bracket which slides over a front of the center bracket.

* * * * *